US007292129B2

(12) United States Patent
Yu

(10) Patent No.: US 7,292,129 B2
(45) Date of Patent: Nov. 6, 2007

(54) PROTECTION DEVICE FOR SWITCHES

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 354 days.

(21) Appl. No.: 11/174,355

(22) Filed: Jul. 2, 2005

(65) Prior Publication Data

US 2007/0001798 A1 Jan. 4, 2007

(51) Int. Cl.

| | |
|---|---|
| ***H01H 37/52*** | (2006.01) |
| ***H01H 37/02*** | (2006.01) |
| ***H01H 71/16*** | (2006.01) |
| ***H01H 71/58*** | (2006.01) |

(52) U.S. Cl. ..... 337/66; 337/85; 337/112; 337/113

(58) Field of Classification Search ..... 337/66, 337/85, 112, 113

See application file for complete search history.

(56) References Cited

U.S. PATENT DOCUMENTS

| | | | | |
|---|---|---|---|---|
| 4,167,720 A | | 9/1979 | Krasser | |
| 4,937,548 A | | 6/1990 | Sdunek | |
| 5,223,813 A | | 6/1993 | Cambreleng | |
| 5,262,748 A | * | 11/1993 | Tsung-Mou | 337/66 |
| 5,451,729 A | | 9/1995 | Onderka | |
| 5,539,371 A | * | 7/1996 | Yu | 337/66 |
| 5,558,211 A | | 9/1996 | Heydner | |
| 5,760,672 A | * | 6/1998 | Wang | 337/79 |
| 5,892,426 A | * | 4/1999 | Huang | 337/59 |
| 6,072,381 A | * | 6/2000 | Yu | 337/37 |
| 6,121,868 A | * | 9/2000 | Chiang | 337/37 |
| 6,275,133 B1 | * | 8/2001 | Chen | 337/37 |
| 6,353,380 B1 | * | 3/2002 | Yu | 337/37 |
| 6,400,250 B1 | * | 6/2002 | Wang | 337/66 |
| 6,452,125 B1 | * | 9/2002 | Yu | 200/553 |
| 6,483,416 B2 | * | 11/2002 | Yu | 337/126 |
| 6,525,639 B1 | * | 2/2003 | Cheng | 337/37 |
| 6,577,221 B1 | * | 6/2003 | Wang | 337/59 |

* cited by examiner

*Primary Examiner*—Anatoly Vortman

(57) ABSTRACT

A switch device includes a body with a switch member pivotably engaged with a top opening of the body and a first terminal and a second terminal respectively extend through a bottom of the body. A bi-metallic plate has a first end fixed to the first terminal and includes a first contact point which is located above a second contact point on the second terminal. A link has an upper end pivotably connected with a protrusion on an underside of the switch member and a lower end of the link clamps the second end of the bimetallic plate. The protrusion includes an engaging hole and an extension slot is in communication with the engaging hole. The upper end of the link has a biasing plate which contacts a contact portion in the body so as to provide a potential force to keep the link upright. When overloaded, the bi-metallic plate is deformed upward and the upper end of the link is moved into the extension slot to ensure that the bi-metallic plate is deformed completely.

7 Claims, 7 Drawing Sheets

(ON)

(OFF)

PROTECTION DEVICE FOR SWITCHES

FIELD OF THE INVENTION

The present invention relates to a protection device for a safety switch to ensure the bi-metallic plate to be deformed as desired when overloaded.

BACKGROUND OF THE INVENTION

A conventional switch device, especially from those switches using bimetallic plate to prevent from being burn when an overload is happened, generally includes a bi-metallic plate which is deformed when overloaded so as to separate the two contact points respectively located on the bimetallic plate and one of the two terminals. U.S. Pat. Nos. 5,262,748; 4,167,720; 4,937,548; 5,223,813; 5,451,729; and 5,558,211 respectively disclose safety switches. Some inherent shortcomings for these conventional safety switch devices are found. There are too many parts involved in the safety switch device and a longer period of time is required when assembling the switch device, this increases the cost of the products. The parts might be arranged inaccurately and would affect the deformation of the bi-metallic plate. Once the bi-metallic plate is deformed to cut off the circuit, because of the improper arrangement of the parts as mentioned above, the bi-metallic plate could deform to reconnect the two contact points to connect the circuit again. Because the inaccuracy of the deformation of the bi-metallic plate, the switch member does not set in the "OFF" position after the bi-metallic plate is deformed to cut off the circuit.

Therefore, it is desired to have a protection device that guides the bi-metallic plate to deform toward a desired direction and there is enough space to allow the bi-metallic plate to deform completely.

SUMMARY OF THE INVENTION

In accordance with an aspect of the present invention, there is provided a switch device that comprises a body with a switch member pivotably engaged with the top opening of the body. A first terminal and a second terminal extend through a bottom of the body. A contact portion extends from an inside of the body. The switch member has an engaging hole and an extension slot in communication with the engaging hole. A contact plate is a curve flexible metal plate and has a first end fixed to the first terminal and a first contact point is connected to an underside of a second end of the contact plate. A second contact point is located above the second terminal. The first contact point is located above the second contact point. A link has an upper end pivotably engaged with the engaging hole and a lower end of the link is connected to the second end of the contact plate. At least one biasing plate extends from a side of the link. When the switch device is in "ON" status, the at least one biasing plate is in contact with the contact portion to provide a potential force to allow the upper end of the link to move into the extension slot under overload condition.

The main object of the present invention is to provide a sufficient space for movement of the link so that when overloaded, the link is allowed to move into the extension slot to let the bi-metallic plate deform completely.

Another object of the present invention is to provide a safety switch wherein the bi-metallic plate is deformed completely when overloaded and does not bounce back to connect the two contact points so that accident sparks are completely avoided.

Yet another object of the present invention is to provide a safety switch that includes less number of parts so as to have lower manufacturing cost.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
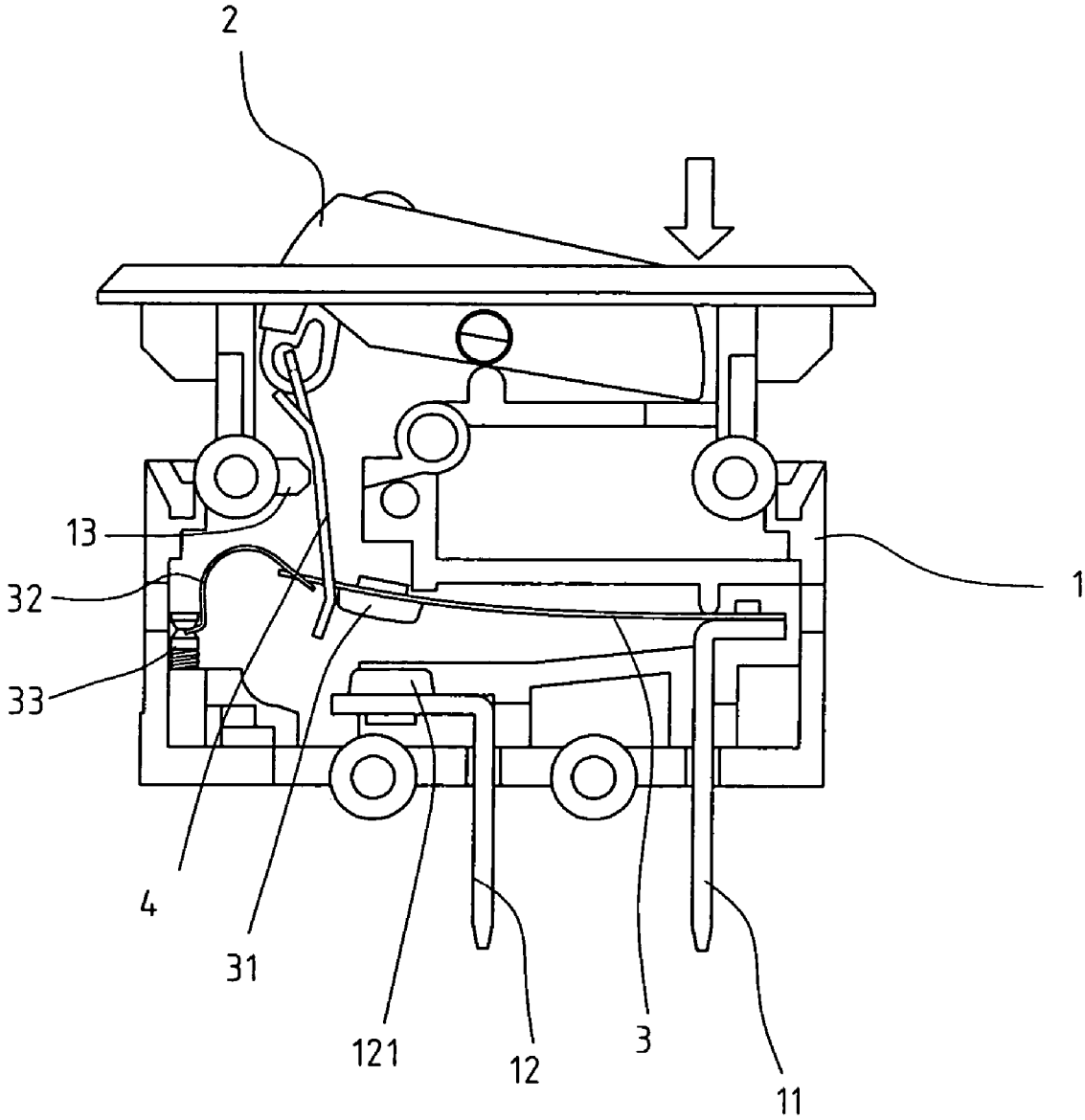
FIG. 1 is a side view to show the "OFF" status of the safety switch device in accordance with the present invention.
Figure 2:
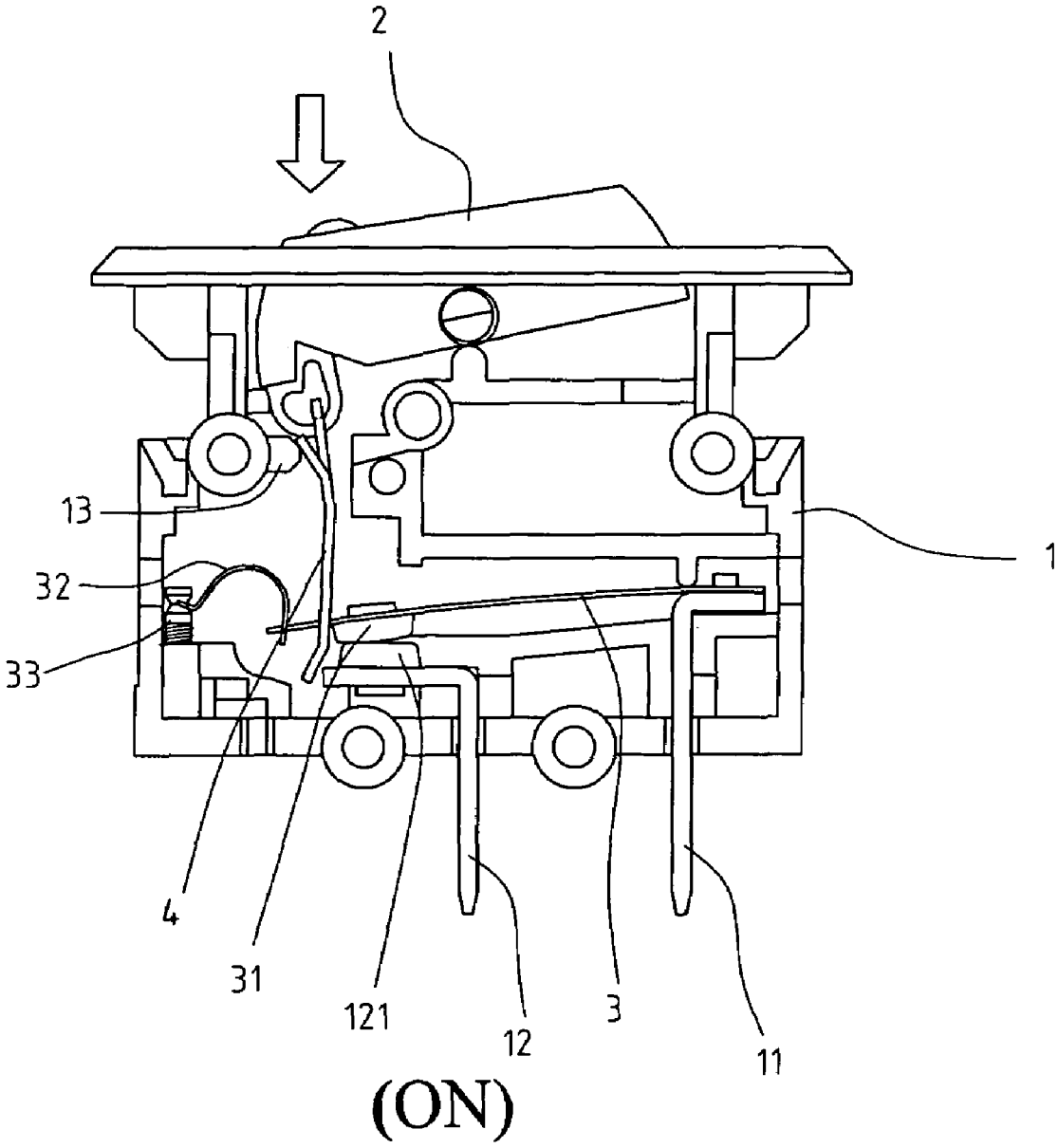
FIG. 2 shows the bi-metallic plate is in "ON" position of the safety switch of the present invention.
Figure 4:
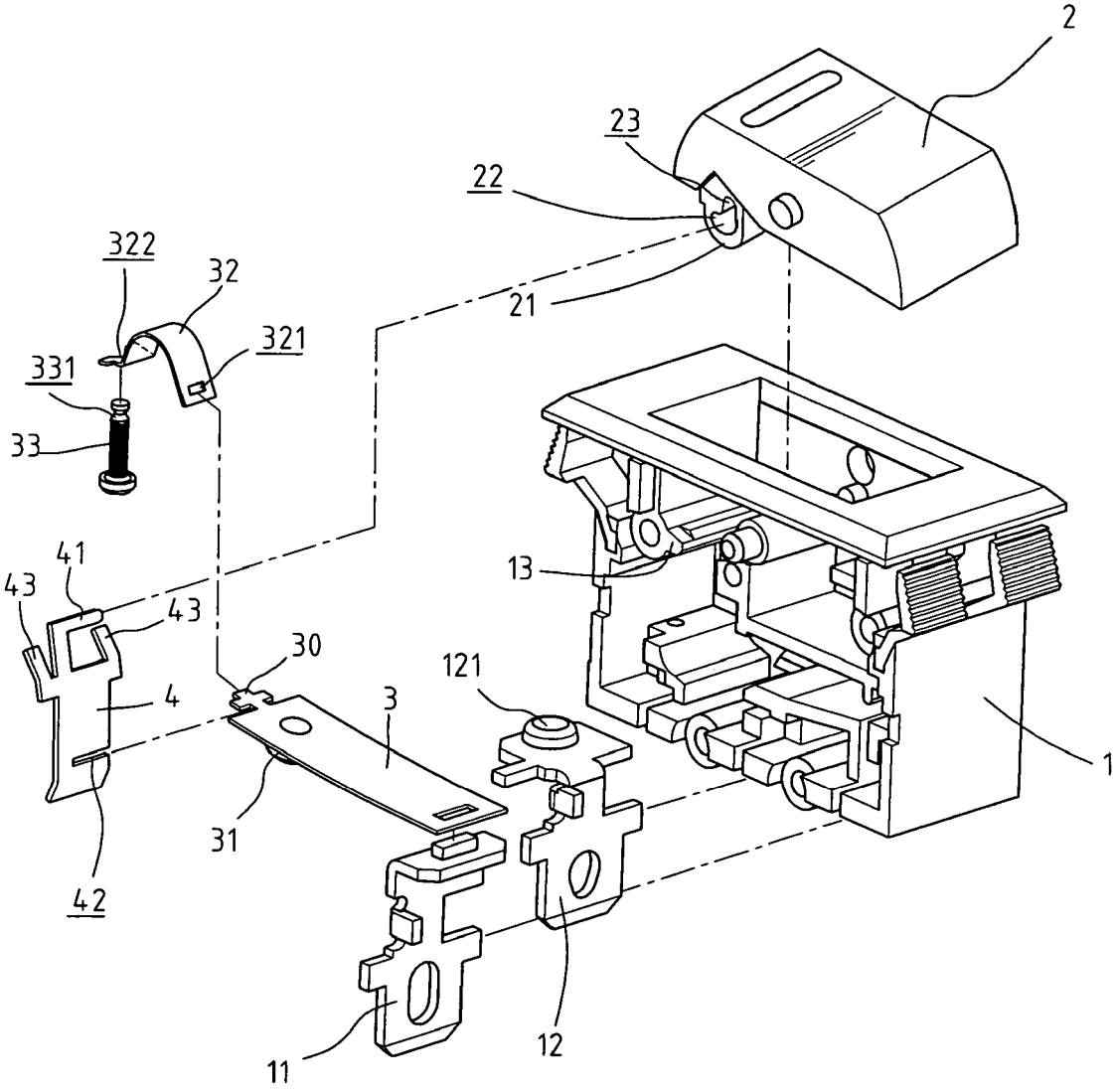
FIG. 4 is an exploded view of the safety switch device in accordance with the present invention.

Referring to the drawings and in particular FIGS. 1, 2 and 4, a safety switch device of the present invention comprises a body 1 with a top opening and a switch member 2 is pivotably engaged with the top opening of the body 1 by a pin so that the switch member 2 can be pivoted about the pin. A first terminal 11 and a second terminal 12 extend through a bottom of the body 1. A contact portion 13 extends from an inside of the body 1. The switch member 2 has a protrusion 21 extending from an underside of an end thereof and an engaging hole 22 is defined in the protrusion 21. An extension slot 23 is in communication with the engaging hole 22.

A contact plate 3, which is a curve flexible bi-metallic plate, has a first end fixed to the first terminal 11 and a first contact point 31 connected to an underside of a second end of the contact plate 3. A second contact point 121 is located on the second terminal 12 and the first contact point 31 located above the second contact point 121. An insertion 30 extends from the second end of the contact plate 3 and is inserted in a restriction hole 321 defined in a first end of a flexible plate 32. A notch 322 is defined in a second end of the flexible plate 32 and is engaged with a groove 331 of an adjustment bolt 33 such that the curvature of the flexible plate 32 can be adjusted by the adjustment bolt 33 to provide desired force to the contact plate 3.

A link 4 has a bar 41 extending from an upper end of the link 4 and the bar 41 is inserted into the engaging hole 22. Two biasing plates 43 extend inclinedly from the link 4. A lower end of the link 4 includes a slit defined in a side thereof and the second end of the contact plate 3 is engaged with the slit 42.

Figure 6:
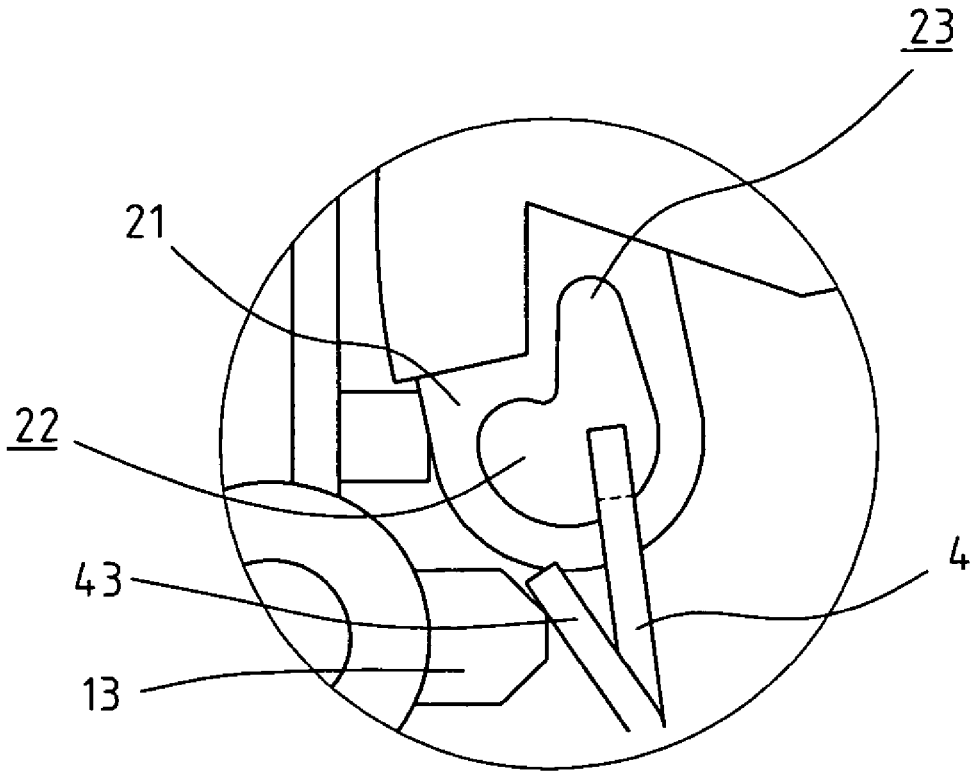
FIG. 6 shows the position of the upper end of the link in the engaging hole when in "ON" status.

Further referring to FIG. 6, when pushing the left end of the switch member 2 downward, the second end of the contact plate 3 is lowered by the downward movement of the link 4 so that the first and second contact points 31, 121 are in contact with each other, and this the "ON" status. The biasing plates 43 are in contact with the contact portion 13 and the extension slot 23 is oriented upright and the upper end of the link 4 is located beneath the extension slot 23.

Figure 5:
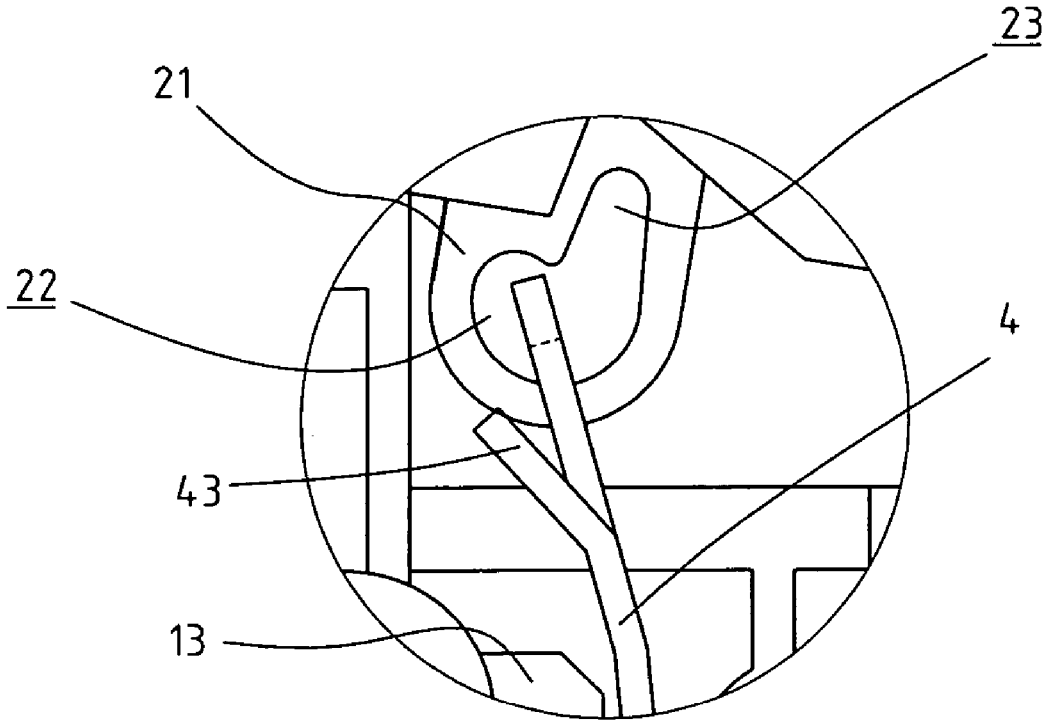
FIG. 5 shows the position of the upper end of the link in the engaging hole when in "OFF" status.

Referring to FIG. 5, when pushing the right end of the switch member 2 downward, the second end of the contact plate 3 is lifted by the upward movement of the link 4 so that the first and second contact points 31, 121 are separated, and this the "OFF" status. The biasing plates 43 are removed from the contact portion 13.

Figure 3:
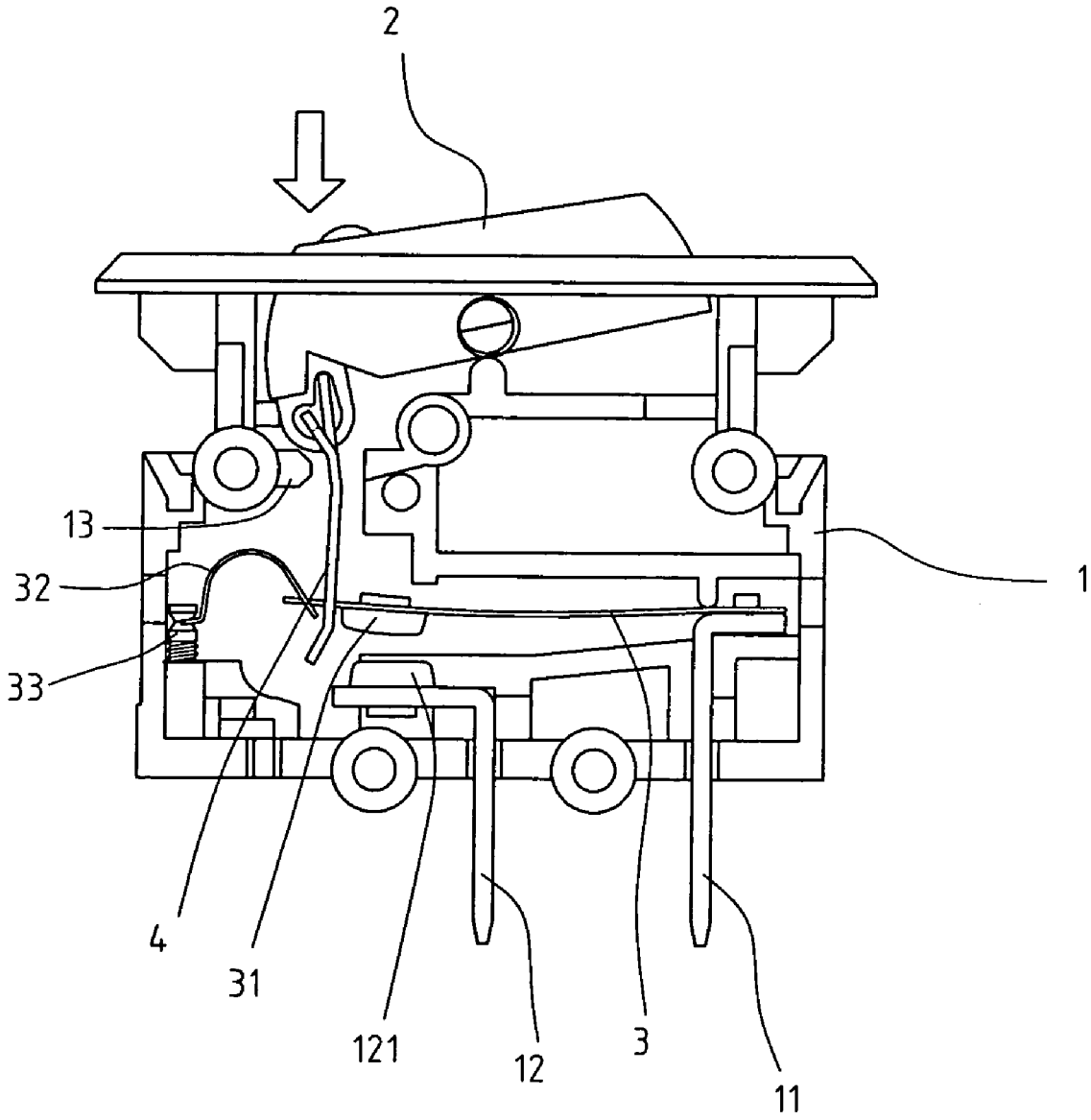
FIG. 3 shows the bi-metallic plate is deformed and the upper end of the link moves in the extension slot under overload condition.
Figure 7:
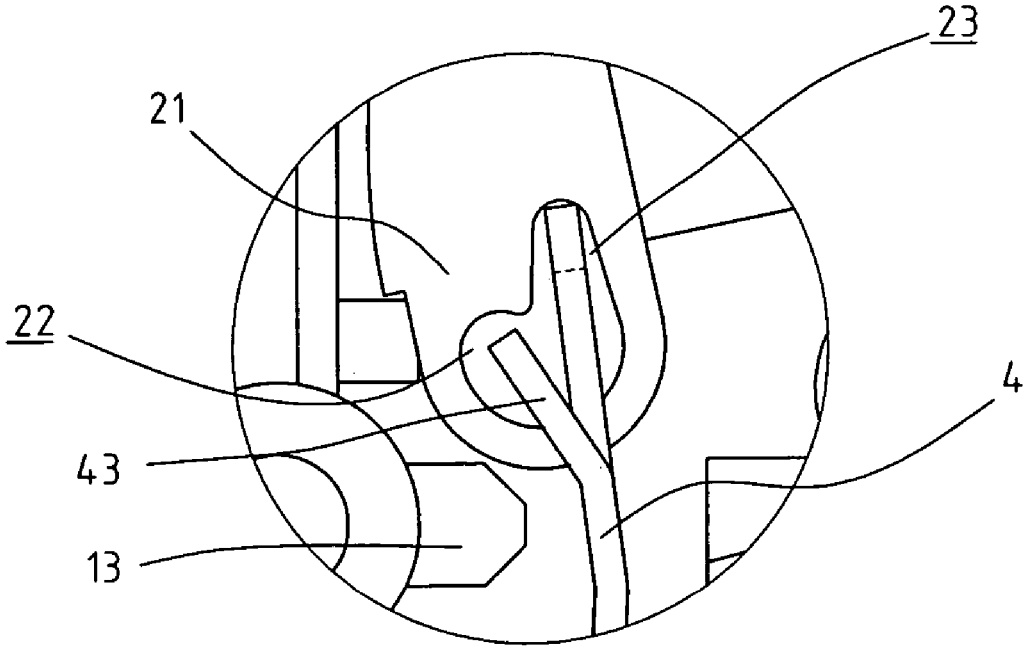
FIG. 7 shows the position of the upper end of the link in the engaging hole under overload condition in "ON" status.

Referring to FIGS. 3 and 7, when the switch device is in "ON" status and the circuit is overloaded, the contact plate 3 is deformed and the second end of the contact plate 7 is bent upward. The link 4 is then moved by the second end of the contact plate 3 and the upper end of the link 4 is moved into the extension slot 23 to allow the deformation of the contact plate 3 to proceed completely.

While we have shown and described the embodiment in accordance with the present invention, it should be clear to those skilled in the art that further embodiments may be made without departing from the scope of the present invention.

What is claimed is:

1. A switch device comprising:

a body with a top opening and a switch member pivotably engaged with the top opening of the body by a pin, a first terminal and a second terminal extending through a bottom of the body, a contact portion extending from an inside of the body, the switch member being pivotable about the pin and an engaging hole and an extension slot being in communication with the engaging hole;

a contact plate being a curved flexible metal plate and having a first end fixed to the first terminal and a first contact point connected to an underside of a second end of the contact plate, a second contact point located on the second terminal, the first contact point located above the second contact point;

a link having an upper end pivotably engaged with the engaging hole and a lower end of the link connected to the second end of the contact plate, at least one biasing plate extending from a side of the link;

when the switch device is in "ON" status, the engaging hole and the extension slot providing the upper end of the link a space and the at least one biasing plate being in contact with the contact portion to provide a potential force to allow the upper end of the link to move into the extension slot when overloaded.

2. The device as claimed in claim 1, wherein a protrusion extends from an underside of an end of the switch member and includes the engaging hole and the extension slot.

3. The device as claimed in claim 1, wherein the lower end of the link includes a slit and the second end of the contact plate is engaged with the slit.

4. The device as claimed in claim 1, wherein the contact plate is a bi-metallic plate.

5. The device as claimed in claim 1, wherein a bar extends from the upper end of the link and is inserted into the engaging hole.

6. The device as claimed in claim 1, wherein the at least one biasing plate extends inclinedly from the link.

7. The device as claimed in claim 1, wherein the extension slot is oriented upright when the switch is in "ON" status so that the upper end of the link moves upright into the extension slot when overloaded.

* * * * *